US005167040A

United States Patent [19]

Lechner

[11] Patent Number: 5,167,040

[45] Date of Patent: Dec. 1, 1992

[54] MOUNTING FRAME FOR THE PRE-WALL INSTALLATION OF A SANITARY FIXTURE

[75] Inventor: Peter Lechner, Jona, Switzerland

[73] Assignee: Geberit AG, Jona, Switzerland

[21] Appl. No.: 549,824

[22] Filed: Jul. 9, 1990

[30] Foreign Application Priority Data

Jul. 7, 1989 [CH] Switzerland ..... 2551/89

[51] Int. Cl.[5] ..... E03D 11/00; E03D 11/14

[52] U.S. Cl. ..... 4/252.2; 52/34; 403/405.1; 411/175

[58] Field of Search ..... 4/252 R, 191, DIG. 15; 137/360; 248/57, 58, 220.4, 231.2; 52/27, 34, 35, 36, 173, 220, 221; 403/405.1, 406.1, 243, 252; 411/437, 172, 173, 174, 175, 182, 259, 265, 277; 24/453, 606, 607

[56] References Cited

U.S. PATENT DOCUMENTS

| | | | |
|---|---|---|---|
| 1,545,839 | 7/1925 | Mason | 4/252 R |
| 2,213,394 | 9/1940 | Hoffman | 4/252 R |
| 3,251,073 | 5/1966 | Rawson | 4/252 R |
| 3,273,173 | 9/1966 | Morris et al. | 4/252 R |
| 3,323,143 | 6/1967 | Pope | 4/252 R |
| 3,435,467 | 4/1969 | Flegel et al. | 4/252 R |
| 3,574,899 | 9/1969 | Fisher | 411/172 |
| 3,686,695 | 8/1972 | Mielback et al. | 4/252 R |
| 4,058,859 | 11/1977 | Arrowood | 4/252 R |
| 4,182,216 | 1/1980 | DeCaro | 403/252 X |
| 4,460,298 | 7/1984 | Solarz et al. | 411/182 X |
| 4,558,472 | 12/1985 | Fromme et al. | 4/252 R |
| 4,979,239 | 12/1990 | Klein et al. | 4/252 R |

FOREIGN PATENT DOCUMENTS

| | | | |
|---|---|---|---|
| 2809135 | 9/1979 | Fed. Rep. of Germany | 4/252 R |
| 936418 | 9/1963 | United Kingdom | 411/182 |

*Primary Examiner*—Henry J. Recla
*Assistant Examiner*—Glenn T. Barrett
*Attorney, Agent, or Firm*—Pollock, Vande Sande & Priddy

[57] ABSTRACT

The mounting frame has for attachment of sanitary fixtures two attachment plates (7) provided with holes (9) arranged in a predetermined pattern. Base nuts (11) with threaded bolts (10) are inserted detachably into the holes (9). To attach a sanitary fixture to the threaded bolts (10), a suitable pair of holes is chosen. A vertically adjustable flush pipe (2) can be fixed in position at the desired height by stop cams (5), which are also arranged in a predetermined one-dimensional pattern. A vertically adjustable discharge elbow (12) is also mounted on the frame (20).

8 Claims, 2 Drawing Sheets

MOUNTING FRAME FOR THE PRE-WALL INSTALLATION OF A SANITARY FIXTURE

FIELD OF THE INVENTION

The invention relates to a mounting frame for the pre-wall installation of a sanitary fixture.

BACKGROUND OF THE INVENTION

A mounting frame of this kind is known from "Handbook for Sanitary Planners", 1987 edition, page 11.17 of the applicant company. Since sanitary fixtures to be attached with this type of mounting frame, and in particular the large variety of urinals, differ greatly from one another, it has been necessary to date to stock several sizes of this mounting frame. In addition, care had to be taken that the appropriate mounting frame was available at the mounting site.

SUMMARY OF THE INVENTION

The object of the invention is to provide a mounting frame of the aforementioned kind, which can be used as universally as possible for the pre-wall installation of different sanitary fixtures and urinals. The hole pattern is preferably designed so that each pair of holes is adapted to a threaded sanitary fixture. To position the attachment means it suffices to identify the appropriate pair of holes; this is quite simple with the aid of markings or a plan.

If, according to an embodiment of the invention, the means for attaching the sanitary fixture have a base nut, which is inserted into a hole of the attachment plate, mounting is very simple even without tools. The attachment of the sanitary fixture is extraordinarily firm if the attachment plate, according to another embodiment of the invention, is connected to an upward bend and at least one inwardly directed side bend of the frame, and the attachment plate has a rear bend which is connected to a rear wall of the frame. Thus, even heavy and loadable sanitary fixtures can be installed.

It is advantageous if at least the flush pipe is mounted vertically adjustably on the frame in a predetermined locking pattern. Preferably, the locking pattern for attaching the flush pipe is adapted to the hole pattern of the attachment plate. Thus, a locking position of the flush pipe and a pair of holes of the attachment plate or plates correspond to a threaded sanitary fixture. Preferably, a corresponding locking pattern is also provided for a vertically adjustable adaptation of the discharge pipe or discharge elbow.

Thus, the mounting frame of the invention can be used in a very simple manner and substantially without tools with the usual range of sanitary fixtures, i.e., substantially universally.

BRIEF DESCRIPTION OF THE DRAWINGS

One embodiment of the invention will now be described by way of example with reference to the accompanying drawings.

DESCRIPTION OF PREFERRED EMBODIMENT

Figure 1:
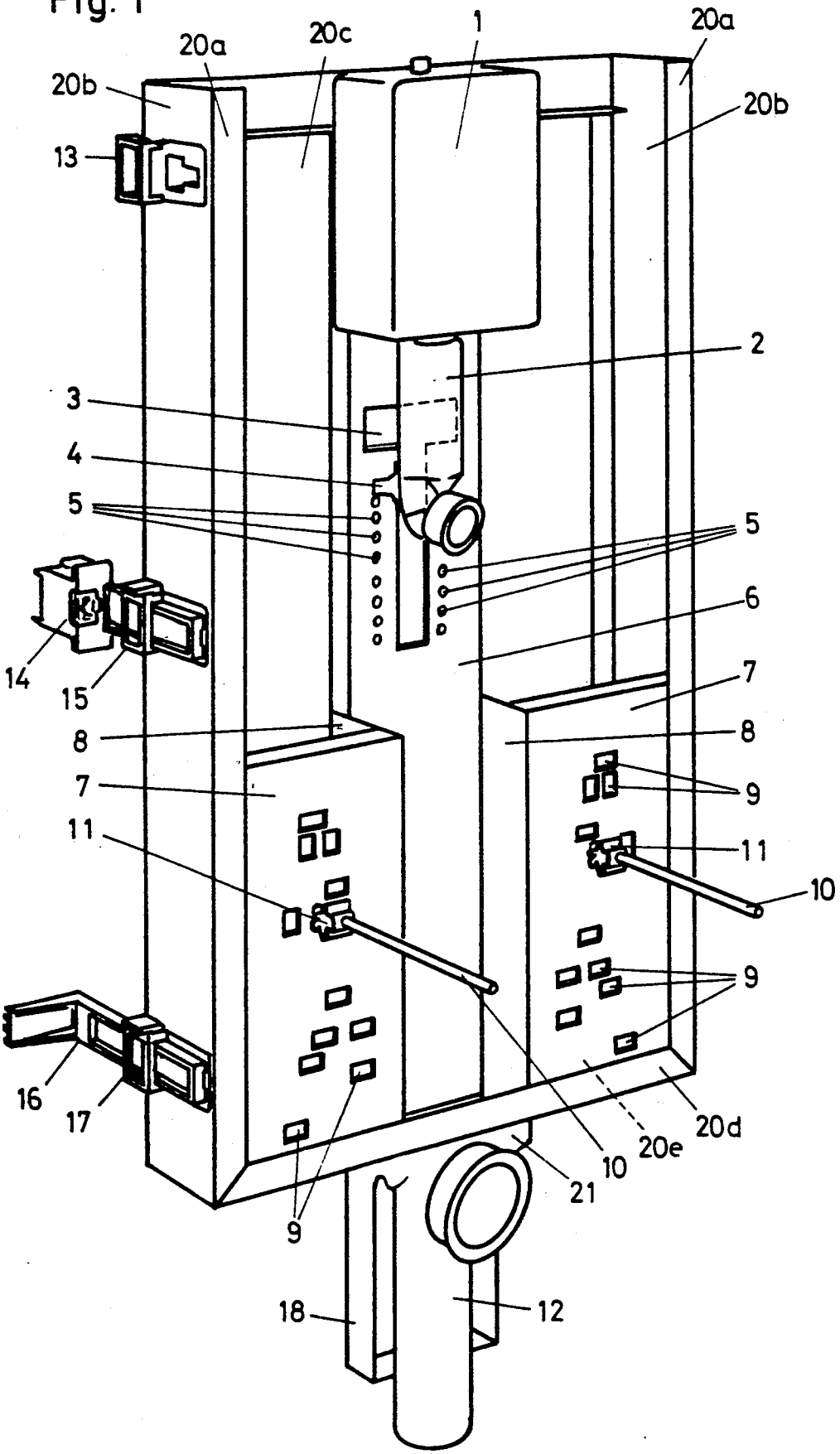
FIG. 1 is a perspective view of a mounting frame according to the invention.

The mounting frame, shown in FIG. 1, has a frame 20 made of galvanized sheet metal and comprising two side walls 20*b*, a bottom 20*e*, and a rear wall 20*c*. To the side walls 20*b* are attached several lateral supports 13, to which in turn angular connecting parts 16 are attached by a bolt 17 in order to mount the mounting frame directly on a building wall. If the mounting frame is attached to attachment channels of an installation module, two attachment parts 14 and 15 are provided.

An attachment channel 6, which extends substantially over the entire height of the rear wall 20*c*, is fastened to the interior of rear wall 20*c*. This attachment channel 6 has a T-shaped aperture 3, in which an attachment plate 4 can be vertically adjusted at the rear of a flush pipe 2. To fix attachment plate 4 or flush pipe 2 in position on frame 20, attachment channel 6 comprises several stop cams 5 in a predetermined locking pattern. Two retaining elements 4*b*, which engage laterally with aperture 3, are fastened to the rear of attachment plate 4. In addition, attachment plate 4 comprises side wings 4*c*, each of which has a rear recess 4*a* in which stop cams 5 can engage. The locking pattern of cams 5 is adapted to the relevant dimensions of the sanitary fixtures to be attached. Prior to attachment of the sanitary fixture to the mounting frame, flush pipe 2 with attachment plate 4 is moved vertically until the appropriate pair of stop cams catches. A flush tank 1 with a magnetic flush valve and possibly an electronic approach detector is arranged at the top of flush pipe 2. This flush tank 1 can be connected securely to rear wall 20*c*, and may also be vertically adjustable with flush pipe 2.

A holder 18 to which a vertically adjustable discharge pipe 12 with attachment plate 21 is also attached is mounted at the bottom of frame 20. Discharge pipe 12, like flush pipe 2, is preferably fixed in lockable and vertically adjustable position.

To attach the sanitary fixture to frame 20, two mirror-symmetrical plates 7 and two threaded bolts 10 are fastened detachably to said frame. Threaded bolts 10 correspond to two receiving openings on the sanitary fixture into which these threaded bolts are inserted and fastened by means of nuts and cover casings and washers. The attachment of such threaded bolts 10 or wall plugs to a sanitary fixture is generally known.

Figure 2A:
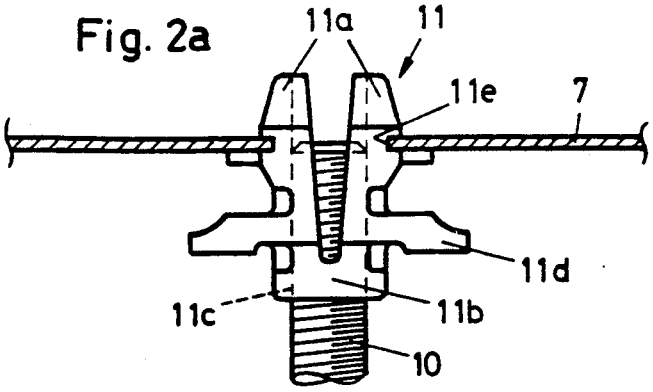
FIGS. 2*a* and 2*b* are views of a base nut.
Figure 2B:
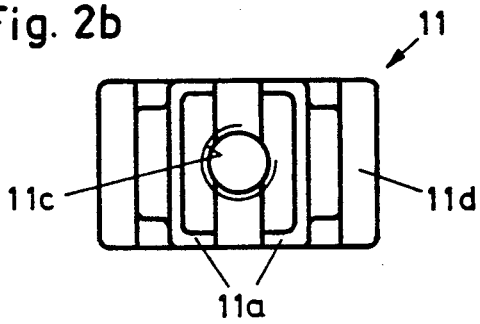
Figure 3A:
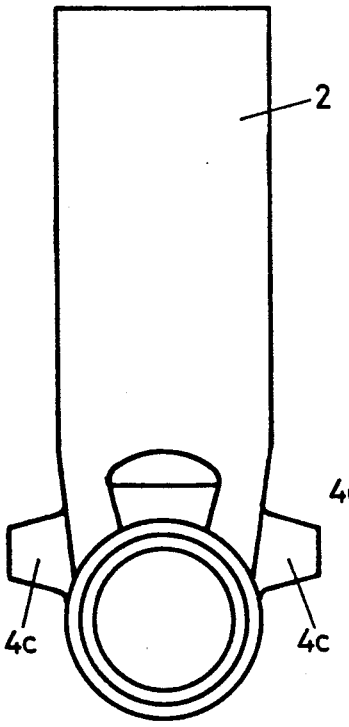
FIGS. 3*a* to 3*c* are views of a flush pipe.
Figure 3B:
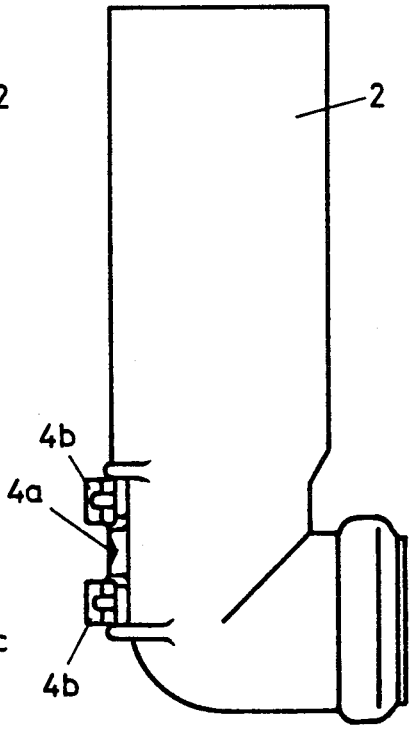
Figure 3C:
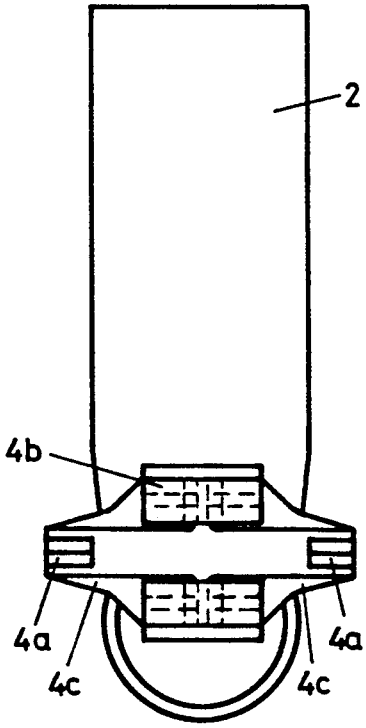

To fasten threaded bolts 10 on frame 20, base nuts 11, which are inserted and locked into rectangular holes of attachment plates 7, are placed on said bolts. As shown in FIGS. 2*a* and 2*b*, these base nuts 11, made, for example, of suitable plastic, have flexible stop lugs 11*a* with lateral grooves 11*e* in which the edges of holes 9 engage lockingly. On a base 11*b*, there is a tapped bore 11*c* into which threaded bolt 10 is screwed. The result of locking base nut 11 is that stop lugs 11*a* (FIG. 2*a*) have a clamping effect on threaded rod 10, which is thereby locked against rotation. Additional means to secure threaded rod 10 are thus dispensible. The base nut 11 can also be sprayed on the threaded bolt 10. A collar 11*d* by which the base nut 11 can be grasped and, if necessary, released again, is molded on base 11*b*.

Each of the two attachment plates 7 has a rear bend 8, which is fastened, for example, by welding to the attachment channel 6. In addition, attachment plates 7 are fastened to an upward bend 20*d* of base 20*e* and to an inwardly turned lateral bend 20*a* respectively.

Holes 9 of attachment plates 7 are arranged in a predetermined, two-dimensional locking pattern, which corresponds to the type of sanitary fixture or urinal to be fastened to the mounting frame. Depending on the sanitary fixture, the threaded bolts are inserted with base nuts 11 into one or another pair of holes. The locking patterns of holes 9 and of stop cams 5 and those of the discharge elbow 12 are readjusted with respect to one another depending on the sanitary fixtures to be attached. However, it is also conceivable that, for example, the discharge pipe be vertically adjustable in a continuum of positions.

Despite the significant advantages of the mounting frame of the invention, the same can be assembled from relatively few, simple, and sturdy components, and thus meets superbly not only the technical requirements for a very simple mounting, but is also reliable and cost-effective due to the ease with which it can be implemented.

What is claimed is:

1. Mounting frame assembly for pre-wall installation of a sanitary fixture including a frame (20), a flush pipe (2), a discharge pipe (12) and means (10, 11) for attaching said sanitary fixture to said mounting frame, wherein (a) at least one of said flush pipe (2) and said discharge pipe (12) is mounted vertically adjustably on said frame (20);

(b) at least one attachment plate (7) with holes arranged in a predetermined two-dimensional hole pattern for said attachment means (10, 11) is mounted on said frame (20);

(c) said attachment means each comprise a base nut (11) which is inserted on a front side of said attachment plate into a hole (9) of said hole pattern, said base nut having a tapered threaded bore therethrough; and (d) said base nut (11) comprises stop lugs on opposing sides of said bore (11*a*), which, upon insertion of said base nut (11) into a hole (9) of said hole pattern, engage said hole whereby a threaded rod (10) inserted into said tapered bore would be clamped against rotation into said base nut (11).

2. Mounting frame according to claim 1, wherein said frame (20) has an upward bend (20*d*) and at least one lateral bend (20*a*), and said at least one attachment plate (7) is connected to said upward bend and said at least one lateral bend, and said at least one attachment plate has a rear bend (8) which is connected to a rear wall (20*c*) of said frame.

3. Mounting frame according to claim 1, wherein said holes (9) are rectangular and said base nuts (11) are configured correspondingly.

4. Mounting frame according to claim 1, wherein said flush pipe (2) is adapted to be fixed in position by means of a locking device (5, 4).

5. Mounting frame according to claim 4, wherein said flush pipe (2) is guided for vertical adjustment in a slot (3) on a rear wall (20*c*) of said frame and has a flush pipe attachment plate (4), and comprising projecting stop means adjacent to said slot (3) for engaging said flush pipe attachment plate (4) and locking said flush pipe attachment plate in position at selected heights when said flush pipe (2) is moved.

6. Mounting frame according to claim 1, comprising a vertical fastening channel (6) attached to a rear wall of said frame, said attachment plate (7) having at least one rear bend (8), said flush pipe (2) and said at least one rear bend (8) of said attachment plate (7) being attached to said fastening channel.

7. Mounting frame according to claim 1, wherein said frame has side walls (20*b*) comprising lateral supports (13) and fastening means (14–17) for assembling said mounting frame to a wall.

8. Mounting frame according to claim 1, wherein said base nuts (11) are made of plastic.

* * * * *